US007422532B2

(12) United States Patent
Goldsmith et al.

(10) Patent No.: US 7,422,532 B2
(45) **Date of Patent: *Sep. 9, 2008**

(54) HOCKEY STICK

(75) Inventors: Edward M Goldsmith, Granada Hills, CA (US); James L. Easton, Los Angeles, CA (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/484,339

(22) Filed: Jul. 10, 2006

(65) Prior Publication Data

US 2006/0287142 A1 Dec. 21, 2006

Related U.S. Application Data

(63) Continuation of application No. 11/318,326, filed on Dec. 23, 2005, now Pat. No. 7,144,343, which is a continuation of application No. 09/929,299, filed on Aug. 14, 2001, now abandoned, which is a continuation of application No. 09/479,429, filed on Jan. 7, 2000, now abandoned.

(51) Int. Cl.
*A63B 59/14* (2006.01)

(52) U.S. Cl. ..... 473/563

(58) Field of Classification Search ..... 473/560–563
See application file for complete search history.

(56) References Cited

U.S. PATENT DOCUMENTS

| | | | | |
|---|---|---|---|---|
| 1,601,116 | A | 9/1926 | Hall | |
| 2,201,706 | A | 5/1940 | Sukohl | 154/40 |
| 2,304,322 | A | 12/1942 | Werlich | 273/67 |
| 2,649,133 | A | 8/1953 | Just | 154/1.8 |
| 2,674,557 | A | 4/1954 | Boggs | 154/83 |
| 2,762,739 | A | 9/1956 | Wiess | 154/90 |
| 2,774,596 | A | 12/1956 | Bredenberg | 273/67 |
| 2,912,245 | A | 11/1959 | Gardner et al. | 273/67 |
| 2,964,065 | A | 12/1960 | Haroldson | 138/76 |
| 3,020,192 | A | 2/1962 | Stephens et al. | 156/423 |
| 3,125,478 | A | 3/1964 | Pratt | 156/184 |
| 3,353,826 | A | 11/1967 | Traverse | 273/67 |
| 3,489,412 | A | 1/1970 | Franck et al. | 273/67 |
| 3,533,623 | A | 10/1970 | Dumont | 273/67 |
| 3,544,104 | A | 12/1970 | Jenks | 272/66 |

(Continued)

FOREIGN PATENT DOCUMENTS

| | | |
|---|---|---|
| CA | 489072 | 12/1952 |

(Continued)

*Primary Examiner*—Mark S Graham
(74) *Attorney, Agent, or Firm*—Jones Day

(57) ABSTRACT

A hockey stick comprising a blade and a shaft adapted to being joined together. The blade portion having an upper portion and a lower portion and a face. The upper portion being comprised of a defined region having a reduced width dimension in a direction that extends generally perpendicular from the face of the blade when measured relative to regions in the upper portion of the blade that border either side of the defined region. The defined region may also be comprised of a reduced longitudinal bending stiffness in a direction that extends generally perpendicular from the face of the blade when measured relative to regions in the upper portion of the blade that border either side of the defined region.

20 Claims, 5 Drawing Sheets

U.S. PATENT DOCUMENTS

| | | | | |
|---|---|---|---|---|
| 3,561,760 | A | 2/1971 | Klay | 273/67 |
| 3,563,546 | A | 2/1971 | Dawe | 273/67 |
| 3,631,897 | A | 1/1972 | Fischer et al. | 138/141 |
| 3,638,942 | A | 2/1972 | Bassett | 273/67 A |
| 3,720,410 | A | 3/1973 | Saytar | 273/67 A |
| 3,727,936 | A | 4/1973 | Klir et al. | 280/11.13 L |
| 3,809,401 | A | 5/1974 | Hankele | 273/67 A |
| 3,813,098 | A | 5/1974 | Fischer et al. | 273/72 R |
| 3,851,880 | A | 12/1974 | Ritch | 273/128 R |
| 3,859,162 | A | 1/1975 | Johnson et al. | 161/160 |
| 3,910,578 | A | 10/1975 | Brine, Jr. | 273/96 D |
| 3,934,875 | A | 1/1976 | Easton et al. | 273/67 A |
| 3,961,790 | A | 6/1976 | Milligan | 273/67 A |
| 3,970,324 | A | 7/1976 | Howat | 280/610 |
| 3,982,760 | A | 9/1976 | Tiitola | 273/67 A |
| 4,013,288 | A | 3/1977 | Goverde | 273/67 A |
| 4,013,810 | A | 3/1977 | Long | 428/308 |
| D244,790 | S | 6/1977 | Carlson et al. | D34/35 BC |
| 4,052,499 | A | 10/1977 | Goupil et al. | 264/265 |
| 4,059,269 | A | 11/1977 | Tiitola | 273/67 A |
| 4,061,520 | A | 12/1977 | Cecka et al. | 156/245 |
| 4,070,020 | A | 1/1978 | Dano | 273/73 F |
| 4,070,021 | A | 1/1978 | Cecka et al. | 273/73 F |
| 4,076,240 | A | 2/1978 | Haddad | 273/67 A |
| 4,084,818 | A | 4/1978 | Goupil et al. | 273/67 A |
| 4,086,115 | A | 4/1978 | Sweet, Jr. et al. | 156/178 |
| 4,124,208 | A | 11/1978 | Burns | 273/67 A |
| 4,124,670 | A | 11/1978 | Cecka et al. | 264/45.3 |
| 4,128,963 | A | 12/1978 | Dano | 264/46.6 |
| 4,129,634 | A | 12/1978 | Cecka et al. | 264/45.3 |
| 4,134,587 | A | 1/1979 | Diederich | 273/67 A |
| 4,148,482 | A | 4/1979 | Harwell, Jr. et al. | 273/67 A |
| 4,159,114 | A | 6/1979 | Ardell et al. | 273/67 A |
| 4,172,594 | A | 10/1979 | Diederich | 237/67 A |
| 4,180,413 | A | 12/1979 | Diederich | 156/185 |
| 4,200,479 | A | 4/1980 | Ardell et al. | 156/154 |
| 4,212,461 | A | 7/1980 | Cecka et al. | 273/73 F |
| 4,239,215 | A | 12/1980 | Farr | 273/29 A |
| 4,241,115 | A | 12/1980 | Temin | 427/384 |
| 4,273,601 | A | 6/1981 | Weingart | 156/189 |
| 4,320,160 | A | 3/1982 | Nishimura et al. | 428/107 |
| 4,343,468 | A | 8/1982 | Lindgren | 273/67 A |
| 4,351,528 | A | 9/1982 | Duplin | 273/67 A |
| 4,353,549 | A | 10/1982 | Goupil et al. | 273/67 A |
| 4,358,113 | A | 11/1982 | McKinnon et al. | 273/67 A |
| 4,358,117 | A | 11/1982 | Deutsch | 273/326 |
| 4,361,325 | A | 11/1982 | Jansen | 273/67 A |
| 4,369,970 | A | 1/1983 | Salminen | 273/67 A |
| 4,461,479 | A | 7/1984 | Mitchell | 273/81 A |
| 4,488,721 | A | 12/1984 | Franck et al. | 273/67 A |
| 4,504,344 | A | 3/1985 | Helle et al. | 156/185 |
| 4,512,573 | A | 4/1985 | Coolen | 273/67 A |
| 4,520,042 | A | 5/1985 | Smith | 427/209 |
| 4,537,398 | A | 8/1985 | Salminen | 273/67 A |
| 4,570,932 | A | 2/1986 | Cote | 273/67 A |
| 4,579,617 | A | 4/1986 | Öberg et al. | 156/184 |
| 4,591,155 | A | 5/1986 | Adachi | 273/67 A |
| 4,600,192 | A | 7/1986 | Adachi | 273/67 A |
| 4,651,990 | A | 3/1987 | Profit | 273/67 A |
| 4,660,832 | A | 4/1987 | Shomo | 273/73 J |
| 4,664,379 | A | 5/1987 | Melby | 273/67 A |
| 4,684,130 | A | 8/1987 | Drolet et al. | 273/67 A |
| 4,739,994 | A | 4/1988 | Lewis, Jr. | 273/326 |
| 4,765,856 | A | 8/1988 | Doubt | 156/212 |
| 4,770,915 | A | 9/1988 | Nakagawa et al. | 428/74 |
| 4,793,616 | A | 12/1988 | Fernandez | 273/167 H |
| 4,799,985 | A | 1/1989 | McMahon et al. | 156/166 |
| 4,818,318 | A | 4/1989 | McMahon et al. | 156/166 |
| 4,871,491 | A | 10/1989 | McMahon et al. | 264/29.2 |
| 4,874,563 | A | 10/1989 | McMahon et al. | 264/29.2 |
| 4,923,541 | A | 5/1990 | Burger | 156/87 |
| 4,968,032 | A | 11/1990 | Redekop | 273/67 A |
| 5,024,712 | A | 6/1991 | Lecourt et al. | 156/184 |
| 5,042,804 | A | 8/1991 | Uke et al. | 273/75 |
| 5,042,805 | A | 8/1991 | Nakai | 273/80 B |
| 5,048,441 | A | 9/1991 | Quigley | 114/90 |
| 5,050,878 | A | 9/1991 | Deleris | 273/67 A |
| 5,067,726 | A | 11/1991 | Brine, III et al. | 273/326 |
| 5,076,872 | A | 12/1991 | Nakagawa et al. | 156/166 |
| 5,078,396 | A | 1/1992 | Cavallaro et al. | 273/67 A |
| 5,127,649 | A | 7/1992 | Carbeonero | 273/67 A |
| D329,888 | S | 9/1992 | Christian | D21/211 |
| 5,160,135 | A | 11/1992 | Hasegawa | 273/67 A |
| 5,174,567 | A | 12/1992 | Nordstrom | 273/67 A |
| 5,183,264 | A | 2/1993 | Lanctot | 273/67 A |
| 5,188,872 | A | 2/1993 | Quigley | 428/36.2 |
| 5,206,085 | A | 4/1993 | Nakagawa et al. | 428/372 |
| 5,217,221 | A | 6/1993 | Baum | 273/67 A |
| 5,242,637 | A | 9/1993 | Inoue et al. | 264/45.3 |
| 5,261,662 | A | 11/1993 | Prevost | 273/67 A |
| 5,303,916 | A | 4/1994 | Rodgers | 273/67 A |
| 5,306,003 | A | 4/1994 | Pagotto | 273/67 A |
| 5,312,100 | A | 5/1994 | Ilacqua et al. | 273/67 A |
| 5,332,212 | A | 7/1994 | Susi et al. | 273/67 A |
| 5,333,857 | A | 8/1994 | Lallemand | 273/67 A |
| 5,364,693 | A | 11/1994 | Moren et al. | 428/263 |
| 5,380,002 | A | 1/1995 | Spector | 273/58 H |
| 5,407,195 | A | 4/1995 | Tiitola et al. | 273/67 A |
| 5,419,553 | A | 5/1995 | Rodgors | 273/67 A |
| 5,423,531 | A | 6/1995 | Hoshizaki et al. | 273/67 A |
| 5,423,735 | A | 6/1995 | Callinan et al. | 602/8 |
| 5,435,548 | A | 7/1995 | Leduke et al. | 273/67 A |
| 5,439,215 | A | 8/1995 | Ratchford | 273/67 A |
| 5,456,463 | A | 10/1995 | Dolan et al. | 273/67 A |
| 5,458,330 | A | 10/1995 | Baum | 273/72 R |
| RE35,081 | E | 11/1995 | Quigley | 428/36.2 |
| 5,470,067 | A | 11/1995 | Diresta | 273/57.2 |
| 5,492,425 | A | 2/1996 | Carter et al. | 401/10 |
| 5,496,027 | A | 3/1996 | Christian et al. | 273/67 A |
| 5,511,776 | A | 4/1996 | Huru | 273/67 A |
| 5,520,385 | A | 5/1996 | Quigley et al. | 273/57.2 |
| 5,524,884 | A | 6/1996 | Haines | 273/67 R |
| 5,533,723 | A | 7/1996 | Baum | 273/72 R |
| 5,549,947 | A | 8/1996 | Quigley et al. | 428/36.2 |
| 5,556,677 | A | 9/1996 | Quigley et al. | 428/36.2 |
| 5,558,326 | A | 9/1996 | Adamson et al. | 273/67 A |
| 5,577,725 | A | 11/1996 | Pagotto et al. | 273/67 A |
| 5,582,405 | A | 12/1996 | Montgomery | 273/67 A |
| 5,582,406 | A | 12/1996 | Babcock | 273/67 A |
| 5,593,158 | A | 1/1997 | Filice et al. | 473/520 |
| 5,599,242 | A | 2/1997 | Solviche et al. | 473/318 |
| 5,603,498 | A | 2/1997 | Crawford et al. | 473/563 |
| 5,607,154 | A | 3/1997 | Meumann et al. | 473/562 |
| 5,607,226 | A | 3/1997 | Toth et al. | 362/251 |
| 5,624,115 | A | 4/1997 | Baum | 473/567 |
| 5,628,509 | A | 5/1997 | Christian | 473/562 |
| 5,633,299 | A | 5/1997 | Van Druten et al. | 524/14 |
| 5,636,836 | A | 6/1997 | Carroll et al. | 473/561 |
| 5,653,468 | A | 8/1997 | Ostapyk | 280/809 |
| 5,653,643 | A | 8/1997 | Falone et al. | 473/300 |
| 5,655,981 | A | 8/1997 | Reed | 473/560 |
| 5,674,141 | A | 10/1997 | Laforest | 473/559 |
| 5,676,608 | A | 10/1997 | Christian et al. | 473/563 |
| 5,685,791 | A | 11/1997 | Feeney | 473/513 |
| 5,685,792 | A | 11/1997 | Ruoff | 473/563 |
| 5,688,571 | A | 11/1997 | Quigley et al. | 428/36.1 |
| 5,690,850 | A | 11/1997 | Anderson | 219/535 |
| 5,695,416 | A | 12/1997 | Christian | 473/562 |
| 5,697,857 | A | 12/1997 | Christian et al. | 473/563 |
| 5,700,533 | A | 12/1997 | You | 428/36.3 |
| 5,718,647 | A | 2/1998 | Tiitola | 473/562 |
| 5,728,008 | A | 3/1998 | Howard | 473/308 |
| 5,728,016 | A | 3/1998 | Hsu | 473/563 |
| 5,744,528 | A | 4/1998 | Callinan et al. | 524/265 |

| | | | | |
|---|---|---|---|---|
| 5,746,955 | A | 5/1998 | Calapp et al. | 264/103 |
| 5,772,541 | A | 6/1998 | Buiatti | 473/520 |
| 5,816,949 | A | 10/1998 | Dutchburn | 473/563 |
| 5,816,962 | A | 10/1998 | Etersque | 473/563 |
| 5,816,963 | A | 10/1998 | Brooks et al. | 473/564 |
| 5,823,901 | A | 10/1998 | Burger | 473/560 |
| 5,827,141 | A | 10/1998 | Lukey et al. | 473/563 |
| 5,839,977 | A | 11/1998 | Maurer et al. | 473/446 |
| D404,449 | S | 1/1999 | Burger | D21/727 |
| 5,863,268 | A | 1/1999 | Birch | 473/563 |
| 5,863,269 | A | 1/1999 | Filice | 473/562 |
| 5,865,694 | A | 2/1999 | Duong-Van | 473/520 |
| 5,865,696 | A | 2/1999 | Calapp et al. | 473/561 |
| 5,866,051 | A | 2/1999 | Lin et al. | 264/45.9 |
| 5,879,250 | A | 3/1999 | Tahtinen et al. | 473/561 |
| 5,888,601 | A | 3/1999 | Quigley et al. | 428/36.1 |
| 5,904,873 | A | 5/1999 | Sadler et al. | 219/535 |
| 5,928,090 | A | 7/1999 | Cabales et al. | 473/318 |
| D412,544 | S | 8/1999 | Burger | D21/727 |
| 5,943,767 | A | 8/1999 | Milam | 29/800 |
| 5,967,913 | A | 10/1999 | Sulenta | 473/560 |
| 5,979,288 | A | 11/1999 | Gallagher et al. | 87/36 |
| 5,980,404 | A | 11/1999 | Gentile | 473/560 |
| 5,980,674 | A | 11/1999 | Burger | 156/189 |
| 5,997,970 | A | 12/1999 | You | 428/36.2 |
| 6,001,035 | A | 12/1999 | Roberts | 473/562 |
| 6,004,900 | A | 12/1999 | O'Brien, III | 503/227 |
| 6,019,691 | A | 2/2000 | Hillborn | 473/563 |
| 6,033,326 | A | 3/2000 | Lee | 473/560 |
| 6,033,327 | A | 3/2000 | Bird | 473/560 |
| 6,033,328 | A | 3/2000 | Bellefleur et al. | 473/561 |
| 6,036,610 | A | 3/2000 | Lewark | 473/564 |
| 6,039,661 | A | 3/2000 | Christian et al. | 473/562 |
| 6,045,906 | A | 4/2000 | McMahon et al. | 428/364 |
| 6,062,995 | A | 5/2000 | Murphy et al. | 473/562 |
| 6,062,996 | A | 5/2000 | Quigley | 473/563 |
| 6,063,839 | A | 5/2000 | Oosedo et al. | 523/206 |
| D430,249 | S | 8/2000 | Burger | D21/757 |
| 6,102,819 | A | 8/2000 | Christian et al. | 473/563 |
| D431,273 | S | 9/2000 | Burger | D21/757 |
| 6,113,508 | A | 9/2000 | Locarno et al. | 473/516 |
| 6,117,029 | A | 9/2000 | Kunisaki et al. | 473/561 |
| 6,129,962 | A | 10/2000 | Quigley et al. | 428/36.1 |
| 6,152,840 | A | 11/2000 | Baum | 473/564 |
| 6,155,932 | A | 12/2000 | Cabales et al. | 473/319 |
| 6,176,640 | B1 | 1/2001 | Gonczi | 403/375 |
| 6,183,384 | B1 | 2/2001 | Roberto | 473/563 |
| 6,203,447 | B1 | 3/2001 | Dillard | 473/316 |
| 6,206,793 | B1 | 3/2001 | Burger | 473/561 |
| D440,617 | S | 4/2001 | Goldsmith et al. | D21/753 |
| 6,224,505 | B1 | 5/2001 | Burger | 473/561 |
| 6,234,923 | B1 | 5/2001 | Gentile | 473/563 |
| 6,241,633 | B1 | 6/2001 | Conroy | 473/561 |
| 6,248,031 | B1 | 6/2001 | Brodie | 473/560 |
| 6,250,193 | B1 | 6/2001 | Head | 87/2 |
| 6,257,997 | B1 | 7/2001 | Doble et al. | 473/516 |
| 6,267,697 | B1 | 7/2001 | Sulenta | 473/560 |
| 6,273,829 | B1 | 8/2001 | Carlson et al. | 473/316 |
| 6,273,835 | B1 | 8/2001 | Battis et al. | 473/563 |
| 6,274,230 | B1 | 8/2001 | Sarrelongue et al. | 428/293.7 |
| 6,306,474 | B1 | 10/2001 | Yoshioka et al. | 428/36.4 |
| 6,352,485 | B1 | 3/2002 | Philpot et al. | 473/564 |
| 6,358,166 | B1 | 3/2002 | Yu | 473/561 |
| 6,364,792 | B1 | 4/2002 | Evanochko | 473/560 |
| 6,364,793 | B1 | 4/2002 | Valarik | 473/563 |
| 6,395,210 | B1 | 5/2002 | Head et al. | 264/137 |
| 6,399,199 | B1 | 6/2002 | Fujino et al. | 428/396 |
| 6,403,504 | B1 | 6/2002 | McMahon et al. | 442/197 |
| 6,515,081 | B2 | 2/2003 | Oosedo et al. | 525/531 |
| 6,525,125 | B1 | 2/2003 | Giardello et al. | 524/439 |
| 6,565,280 | B1 | 5/2003 | Post | 403/325 |
| 6,610,382 | B1 | 8/2003 | Kobe et al. | 428/119 |
| 7,144,343 | B2 * | 12/2006 | Goldsmith et al. | 473/562 |
| 2001/0029813 | A1 | 10/2001 | Schroder | 81/20 |
| 2002/0007022 | A1 | 1/2002 | Oosedo et al. | 525/527 |
| 2002/0061374 | A1 | 5/2002 | O'Brien | 428/36.9 |
| 2002/0107095 | A1 | 8/2002 | Becker | 473/564 |
| 2002/0198071 | A1 | 12/2002 | Snow | 473/564 |

FOREIGN PATENT DOCUMENTS

| | | | |
|---|---|---|---|
| CA | 557838 | | 5/1958 |
| CA | 633295 | | 12/1961 |
| CA | 903285 | | 6/1972 |
| CA | 1043065 | | 11/1978 |
| CA | 1043379 | | 11/1978 |
| CA | 1047561 | | 1/1979 |
| CA | 1063747 | | 10/1979 |
| CA | 1069147 | | 1/1980 |
| CA | 1072142 | | 2/1980 |
| CA | 1138912 | | 1/1983 |
| CA | 1145371 | | 4/1983 |
| CA | 1147767 | | 6/1983 |
| CA | 1151693 | | 8/1983 |
| CA | 1180728 | | 1/1985 |
| CA | 1183883 | | 3/1985 |
| CA | 1187525 | | 5/1985 |
| CA | 1205835 | | 6/1986 |
| CA | 1206309 | | 6/1986 |
| CA | 1206497 | | 6/1986 |
| CA | 1207350 | | 7/1986 |
| CA | 1219886 | | 3/1987 |
| CA | 1230898 | | 12/1987 |
| CA | 2071859 | | 6/1991 |
| CA | 2029109 | | 5/1992 |
| CA | 2037273 | | 8/1992 |
| CA | 2066476 | | 10/1992 |
| CA | 1310674 | | 11/1992 |
| CA | 2071022 | | 12/1992 |
| CA | 2062635 | | 9/1993 |
| CA | 2067087 | | 10/1993 |
| CA | 1328892 | | 4/1994 |
| CA | 2081439 | | 4/1994 |
| CA | 2088899 | | 8/1994 |
| CA | 2120809 | | 10/1994 |
| CA | 2099853 | | 2/1995 |
| CA | 2108069 | | 4/1995 |
| CA | 2105797 | | 5/1995 |
| CA | 2132567 | | 7/1995 |
| CA | 2123248 | | 10/1995 |
| CA | 2125343 | | 12/1995 |
| CA | 2169216 | | 8/1996 |
| CA | 2162444 | | 12/1996 |
| CA | 2160731 | | 4/1997 |
| CA | 2164188 | | 5/1997 |
| CA | 2200663 | | 9/1997 |
| CA | 2180893 | | 1/1998 |
| CA | 2190431 | | 5/1998 |
| CA | 2096304 | | 8/1998 |
| CA | 2228104 | | 9/1998 |
| CA | 2202454 | | 10/1998 |
| CA | 2223098 | | 12/1998 |
| CA | 2086470 | | 2/1999 |
| CA | 2238291 | | 2/1999 |
| CA | 2244610 | | 2/1999 |
| CA | 2262210 | | 8/1999 |
| CA | 2272497 | | 12/1999 |
| CA | 2289988 | | 5/2001 |
| DE | 376009 | | 12/1921 |
| DE | 3238117 | A1 | 6/1983 |
| EP | 0 172 564 | A2 | 2/1986 |
| EP | 0 226 420 | A2 | 6/1987 |
| EP | 0 172 564 | A3 | 10/1987 |
| EP | 0 226 420 | A3 | 3/1988 |
| EP | 0 351 201 | A2 | 1/1990 |
| EP | 0 407 996 | A2 | 1/1991 |

| | | | |
|---|---|---|---|
| EP | 0 441 971 | A1 | 8/1991 |
| EP | 0 407 996 | A3 | 1/1992 |
| EP | 0 226 420 | B1 | 8/1992 |
| EP | 0 523 913 | A1 | 1/1993 |
| EP | 0 532 444 | A1 | 3/1993 |
| EP | 0 585 965 | A1 | 3/1994 |
| EP | 0 597 166 | A2 | 5/1994 |
| EP | 0 407 996 | B1 | 12/1994 |
| EP | 0 597 166 | A3 | 2/1995 |
| EP | 0 662 391 | A2 | 7/1995 |
| EP | 0 662 391 | A3 | 11/1995 |
| EP | 0 441 971 | B1 | 2/1996 |
| EP | 0 523 913 | B1 | 4/1996 |
| EP | 0 733 469 | A2 | 9/1996 |
| EP | 0 733 469 | A3 | 11/1996 |
| EP | 0 742 266 | A2 | 11/1996 |
| EP | 0 597 166 | B1 | 3/1997 |
| EP | 0 764 453 | A1 | 3/1997 |
| EP | 0 487 549 | B1 | 9/1997 |
| EP | 0 504 230 | B1 | 7/1998 |
| EP | 0 742 266 | A3 | 1/1999 |
| EP | 0 927 628 | A1 | 7/1999 |
| EP | 0 947 562 | A1 | 10/1999 |
| FI | 65018 | | 11/1983 |
| GB | 637779 | | 5/1950 |
| GB | 1121051 | | 7/1968 |
| SE | 169928 | | 12/1959 |
| WO | WO 82/03789 | | 11/1982 |
| WO | WO 91/08803 | | 6/1991 |
| WO | WO 91/16955 | | 11/1991 |
| WO | WO 90/15712 | | 12/1991 |
| WO | WO 93/05219 | | 3/1993 |
| WO | WO 94/21334 | | 9/1994 |
| WO | WO 94/23768 | | 10/1994 |
| WO | WO 95/01820 | | 1/1995 |
| WO | WO 95/24245 | | 9/1995 |
| WO | WO 96/01137 | | 1/1996 |
| WO | WO 96/01699 | | 1/1996 |
| WO | WO 96/02385 | | 2/1996 |
| WO | WO 96/13549 | | 5/1996 |
| WO | WO 97/03730 | | 2/1997 |
| WO | WO 97/03820 | | 2/1997 |
| WO | WO 97/29808 | | 8/1997 |
| WO | WO 97/33660 | | 9/1997 |
| WO | WO 97/41929 | | 11/1997 |
| WO | WO 98/01189 | | 1/1998 |
| WO | WO 98/19753 | | 5/1998 |
| WO | WO 98/24616 | | 6/1998 |
| WO | WO 98/41292 | | 9/1998 |
| WO | WO 98/55182 | | 12/1998 |
| WO | WO 99/17845 | | 4/1999 |
| WO | WO 99/32198 | | 7/1999 |
| WO | WO 99/60030 | | 11/1999 |
| WO | WO 00/03769 | | 1/2000 |
| WO | WO 00/09222 | | 2/2000 |
| WO | WO 00/10655 | | 3/2000 |
| WO | WO 00/27632 | | 5/2000 |
| WO | WO 00/32278 | | 6/2000 |
| WO | WO 00/46255 | | 8/2000 |

* cited by examiner

HOCKEY STICK

CROSS-REFERENCE TO RELATED APPLICATIONS

This application is a continuation of a U.S. patent application Ser. No. 11/318,326 filed on Dec. 23, 2005, issuing as U.S. Pat. No. 7,144,343 on Dec. 5, 2006, which is a continuation of U.S. patent application Ser. No. 09/929,299 filed on Aug. 14, 2001, now abandoned, which is a continuation of U.S. patent application Ser. No. 09/479,429 filed on Jan. 7, 2000, now abandoned. Each of these applications is hereby incorporated in their entirety be reference. This application claims the benefit of priority under 35 U.S.C. § 120 to U.S. patent application Ser. No. 11/318,326 filed on Dec. 23, 2005, U.S. patent application Ser. No. 09/929,299 filed on Nov. Aug. 14, 2001, now abandoned, and U.S. patent application Ser. No. 09/479,429 filed on Jan. 7, 2000, now abandoned.

FIELD OF THE INVENTION

The field of the present invention relates to hockey sticks and the blades thereof.

BACKGROUND OF THE INVENTION

Generally, hockey sticks are comprised of a blade portion and a shaft or handle portion. Traditionally, these portions were permanently joined to one another. In more recent times, the blade and shaft have been constructed in a manner that facilitates the user's replacement of the blade (i.e. the blades can be removably detached from the shaft and another blade can be attached and the removed blade can be attached to another shaft). The blades and shafts have been constructed, in whole or in part, using a wide variety of materials, including wood, aluminum, plastic and composite materials such as carbon, graphite, aramides, polyethylene, polyester and glass fibers.

The blade portion is typically comprised of front and back faces, a hosel portion that extends longitudinally toward the shaft from the heel of the blade and a lower portion that extends generally perpendicular relative to the hosel portion away from the heel. In conventional construction, the hosel portion of the blade employs a continuously uniform or a continuously gradually tapering cross-sectional geometry relative to and along its longitudinal axis moving from the upper portion of the hosel near the shaft toward the heel. Consequently, a uniform or gradually tapering longitudinal bending stiffness in the hosel results.

The longitudinal bending stiffness of a member or a section of a member is the stiffness along a given longitudinal axis of the member relative to a defined direction. For example as illustrated in FIG. 9A, a member having a rectangular cross-sectional area has a longitudinal axis defined as Z', a width defined as X, a height defined as Y and a length defined as L, where the width X is greater than the height Y. As illustrated in FIG. 9B, the longitudinal bending stiffness of the member illustrated in FIG. 9A in the direction X' (which as illustrated is perpendicular to the longitudinal axis) may be measured by applying a force F to the member in the direction of X' (i.e. normal to the Z'-Y' plane) and measuring the bending of the member in that direction at a defined position. Alternatively, as illustrated in FIG. 9C, the longitudinal bending stiffness in the Y' direction is measured by applying a force F to the member in the Y' direction (i.e. normal to the Z'-X' plane) and measuring the bending of the member in that direction at a defined position of the member.

The longitudinal bending stiffness in the X' and Y' directions may or may not be the same at a given section or region since the bending stiffness relates to the member's construction which is a function of the member's design, dimensions, geometry, and the properties of the materials employed. Thus, the longitudinal bending stiffness of a given member at a given position may vary depending on the direction in which the longitudinal bending stiffness is measured, and the stiffness at different positions may vary depending on the construction of the member at that position. As illustrated in FIGS. 9B and 9C the bending stiffness in the X' direction is greater than the bending stiffness in the Y' direction for the given force F (i.e. the member bends less in the X' direction than in the Y' direction of a given section when the same force F is applied). The assumption upon which the diagrams in FIGS. 9B and 9C are based is that all other relevant construction factors effecting the bending stiffness in the X' and Y' directions are equal except for the width X being greater than the height Y. Accordingly, a greater longitudinal bending stiffness should result in the X' direction. It should be recognized, however, that the construction of the member can be modified in other respects so as to create a greater relative bending stiffness in the Y' direction despite the width X being greater than the height Y.

The "feel" of a hockey stick is a result of a myriad of factors including the type of materials employed in construction, the structure of the components, the dimensions of the components, the rigidity or bending stiffness of the shaft and blade, the weight and balance of the shaft and blade, the rigidity and strength of the joint(s) connecting the shaft to the blade, the curvature of the blade, etc. Experienced players and the public are often inclined to use hockey sticks that have a "feel" that is comfortable yet provides the desired performance. Moreover, the subjective nature inherent in this decision often results in one hockey player preferring a certain "feel" of a particular hockey stick while another hockey player preferring the "feel" of another hockey stick.

In order to modify the "feel" and/or performance of the hockey stick, the hosel portion of the blade can be uniquely modified in geometry and/or bending stiffness as described in more detail below.

SUMMARY OF THE INVENTION

The present invention relates to hockey sticks. A preferred embodiment relates to hockey stick blades comprising a face, an upper portion, and a lower portion. The upper portion having a longitudinal axis and being comprised of a defined region of reduced longitudinal bending stiffness in a direction that generally extends away from the face of the blade when measured relative to regions in the upper portion of the blade that border either side of the defined region along the longitudinal axis.

Another preferred embodiment relates to hockey sticks comprising a blade and a shaft. The blade is comprised of a face, an upper portion, a heel, and a lower portion. The upper portion having a longitudinal axis generally extending from the heel toward the shaft. The upper portion being comprised of a defined region of reduced longitudinal bending stiffness in a direction that generally extends away from the face of the blade when measured relative to regions in the upper portion of the blade that border either side of the defined region along the longitudinal axis. The blade and shaft are adapted to being joined to one another.

Another preferred embodiment relates to hockey stick blades comprising a face, an upper portion, and a lower portion. The upper portion having a longitudinal axis and being comprised of a defined region having a reduced width dimension in a direction that generally extends away from the face of the blade when measured relative to regions in the upper portion of the blade that border either side of the defined region along the longitudinal axis.

In yet another preferred embodiment relates to hockey sticks comprising a blade and a shaft. The blade is comprised of a face, an upper portion, a heel, and a lower portion. The upper portion having a longitudinal axis generally extending from the heel toward the shaft. The upper portion being comprised of a defined region having a reduced width dimension in a direction that generally extends away from the face of the blade when measured relative to regions in the upper portion of the blade that border either side of the defined region along the longitudinal axis. The blade and shaft are adapted to being joined to one another.

BRIEF DESCRIPTION OF THE DRAWINGS

The accompanying drawings illustrate presently preferred embodiments of the invention and, together with the description, serve to explain various principles of the invention.

DESCRIPTION OF THE PREFERRED EMBODIMENTS

Reference will now be made to the construction and operations of preferred embodiments of the present invention, examples of which are illustrated in the accompanying drawings. The following descriptions of the preferred embodiments of the present invention are only exemplary of the invention. The present invention is not limited to these embodiments, but may be realized by other embodiments.

Figure 1:
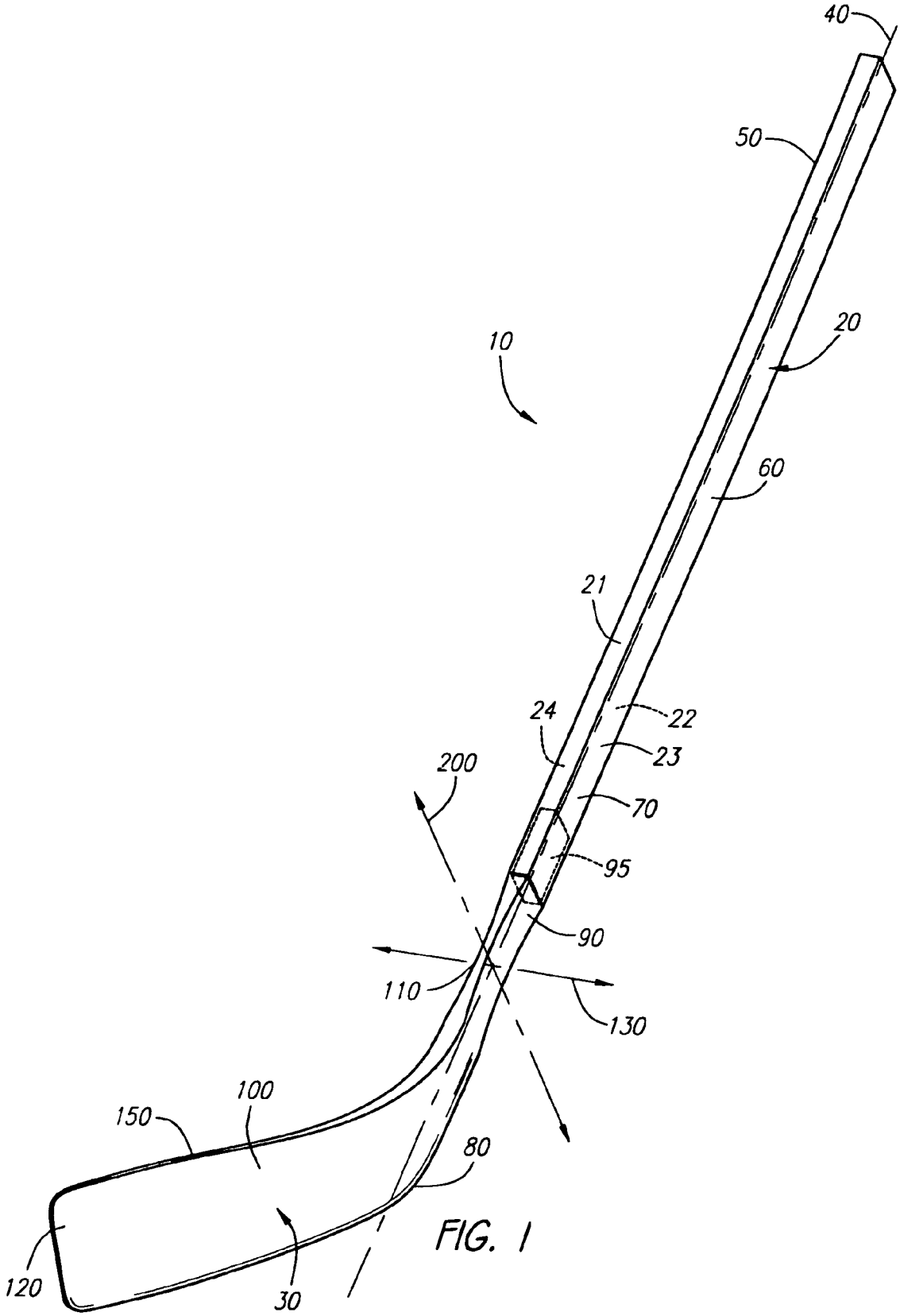
FIG. 1 is a diagram illustrating a hockey stick in accordance with a preferred embodiment.
Figure 2:
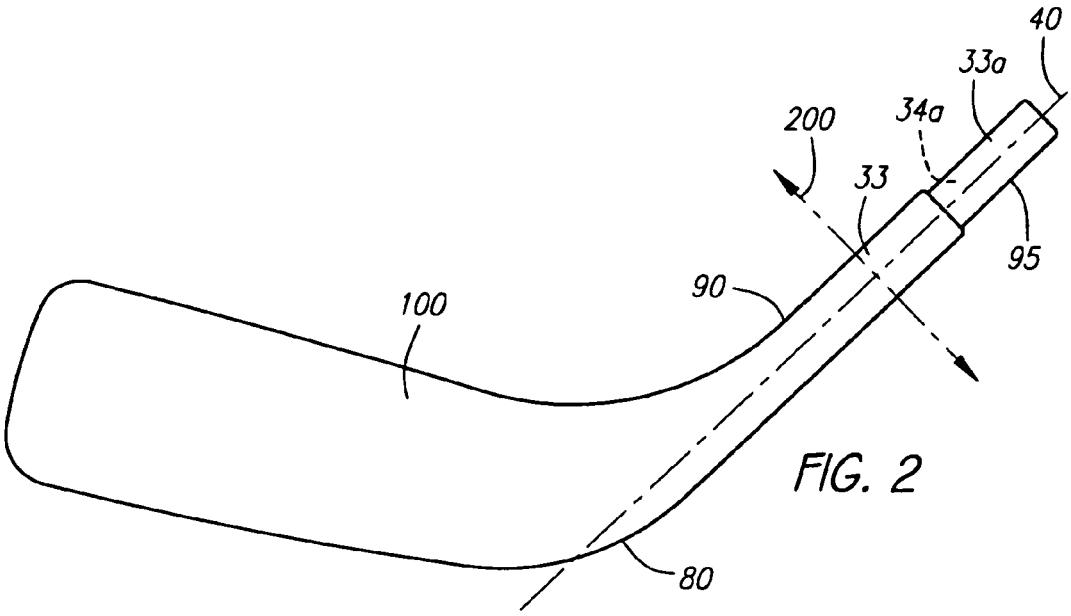
FIG. 2 is a right side view of the hockey stick blade in accordance with the embodiment set forth in FIG. 1.
Figure 3:
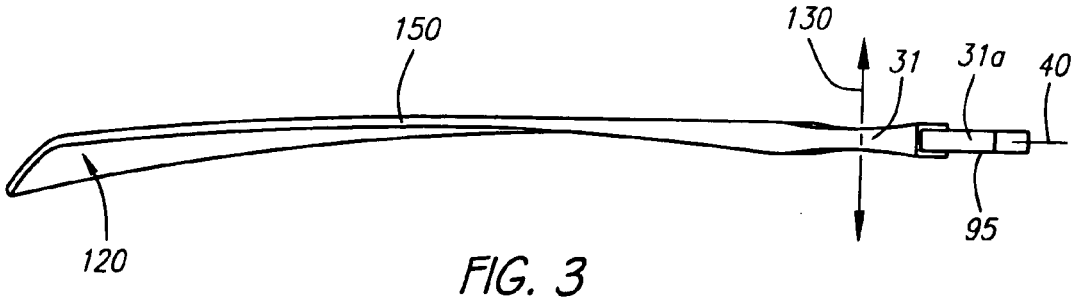
FIG. 3 is a top view of the hockey stick blade in accordance with the embodiment set forth in FIG. 1.
Figure 4:
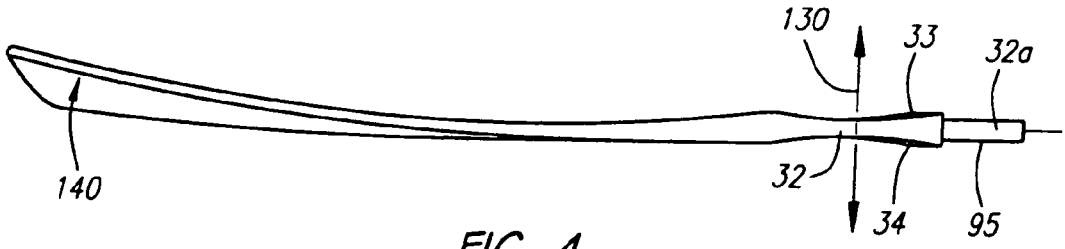
FIG. 4 is a bottom view of the hockey stick blade in accordance with the embodiment set forth in FIG. 1.
Figure 5:
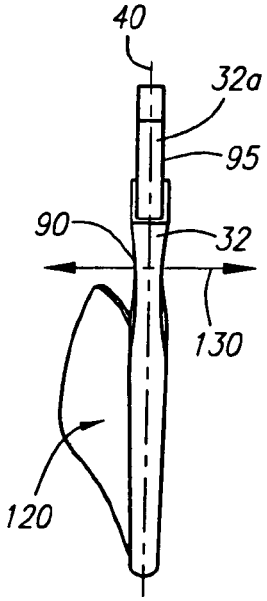
FIG. 5 is a rear view of the hockey stick blade in accordance with the embodiment set forth in FIG. 1.
Figure 6:
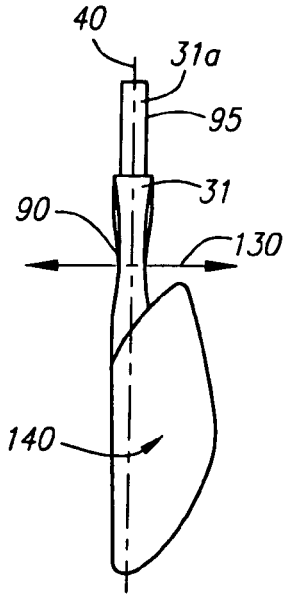
FIG. 6 is a front view of the hockey stick blade in accordance with the embodiment set forth in FIG. 1.
Figure 7:
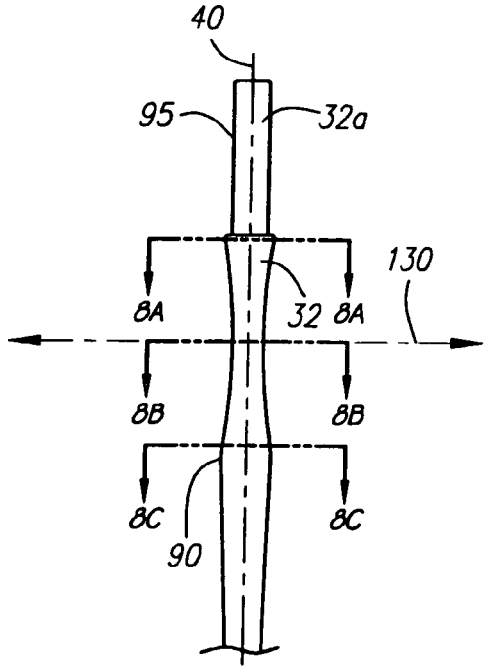
FIG. 7 is a detailed rear view of the focused flex region of the hockey stick blade in accordance with the embodiment set forth in FIG. 1.

FIG. 1 is a diagram illustrating a hockey stick 10 in accordance with a preferred embodiment as disclosed herein. FIGS. 2-7 are diagrams illustrating from different perspectives and views the blade portion of the hockey stick illustrated in FIG. 1. As shown in FIGS. 1-7, a hockey stick 10 is comprised of a handle or shaft 20 and a blade 30. The shaft 20 is preferably comprised of a hollow tubular member having a top section 50, a middle section 60 and a bottom section 70. The cross-sectional area of the shaft 20 is generally rectangular throughout the longitudinal length of the shaft 20 and generally employs two sets of opposed walls 21, 22, 23 and 24. The blade 30 is comprised of a heel 80, an upper portion 90, a lower portion 100 and front and back faces 120 and 140 respectively. The heel 80 is generally defined as the angular junction between the lower portion 100 and upper portion 90. The upper portion 90 in the preferred embodiment is comprised of two sets of opposed walls 31, 32, 33, and 34 and a mating section 95. The mating section 95 in a preferred embodiment is comprised of a rectangular cross section (also having two sets of opposed walls 31*a*, 32*a*, 33*a*, and 34*a*) that is adapted to mate with the bottom section 70 of the shaft 20 in a four-plane lap joint along the inside of walls 21, 22, 23, and 24. The outside diameter of the rectangular cross-sectional area of the mating section 95 is preferably dimensioned to make a sliding fit inside the hollow center of the bottom section 70 of the shaft 20. Preferably, the blade 30 and shaft 20 are bonded together at the four-plane lap joint using an adhesive capable of removably cementing the blades to shafts. Such adhesives are commonly known and employed in the industry and include Z-Waxx™ and hot melt glues. Other mating configurations and methods known in the art may be used as well with the present invention. Alternatively, the blade 30 and shaft 20 may be permanently mounted to one another using construction and assembly structures and techniques known to those of ordinary skill in the art.

In the preferred embodiment, the hockey stick 10 has a longitudinally extending axis 40 that extends from the top section 50 of the shaft 20 through the bottom section 70 of the shaft 20 and through the upper portion 90 of the blade 30 generally toward the heel 80. The upper member 90 further comprises a focused flex region 110, which is preferably comprised of a region of reduced longitudinal bending stiffness in a defined region of the upper portion 90 of the blade 30. The stick has a reduction in longitudinal bending stiffness—or a focused flex region 110—that gives it a higher flexibility about the axis line 200. The present invention is not directed to providing increased flexibility about the axis line 130, but rather in the direction of axis line 130. Put another way, stick of the present invention has a reduction in longitudinal bending stiffness—or a focused flex region 110—that modifies the ability of the stick to flex in the general direction that extends away from the face 120 of the blade 30 (i.e. in a direction generally normal to the plane defined by longitudinal axis 40 and transverse axis 200). The reduction of the bending stiffness is measured relative to the sections of the upper portion 90 of the blade 30 that immediately border either side of the focused flex region 110 moving along the longitudinal axis 40—that is, the sections above and below the focused flex region 110. Hence, the section of the upper portion 90 located above the focused flex region 110 as well as the section of the upper portion 90 of the blade 30 located below the focused flex region 110 have a longitudinal bending stiffness measured in a direction of axis line 130 that is greater than that in the focused flex region 110.

As best illustrated in FIGS. 1 and 3-7, the reduced bending stiffness in the focused flex region 110 may be achieved by modifying the geometry of the upper portion 90 of the blade 30. As shown in a preferred embodiment illustrated in FIGS. 1-8, the widths of the two opposed walls 31 and 32 of the upper portion 90 are reduced generally in the direction of the axis line 130 so as to create a tapered, or hourglass, shape when viewed from a rear perspective as in FIG. 7. The reduction in the bending stiffness in the focused flex region 110 may be controlled using other construction techniques or modifications, in addition to or in combination with modifications to the geometry of the upper portion 90. For example, internal or external structural configurations on the upper portion 90 may be employed to achieve the relative reduction in the bending stiffness in the focused flex region 110. In addition, the materials employed to construct the upper portion 90 in the focused flex region 110 may be varied either in quality (i.e. longitudinal bending stiffness properties) or quantity so as to result in a reduction of bending stiffness without necessarily changing the general structure, outer dimensions, or geometry of the upper portion 90 in the focused flex region 110.

One advantage, however, that is associated with changing the outward geometry of the upper member 90 in the focused flex region 110 is that the focused flex region 110 would be more readily detectable to the consumer and therefore may be advantageous from a marketing perspective. In this regard, a modification in the outer dimensions or geometry of the upper portion 90 without change to the bending stiffness is also contemplated by the present invention. Furthermore, it should be understood that while the focused flex region 110 is depicted in FIGS. 1-7 as being positioned below the rectangular cross sectional area of the mating section 95 it is contemplated that it may be placed within the this area as well.

One advantage offered by the present invention is that it allows the stick designer to create a specific point, or area, where the stick will flex the most. This focused flex region 110 can be used to create a stick with a lower flex point than other sticks known in the art. This can be used to create a stick with different feel and an increased ability to generate lift on the puck—that is, to shoot the puck into the air.

Figure 8A:
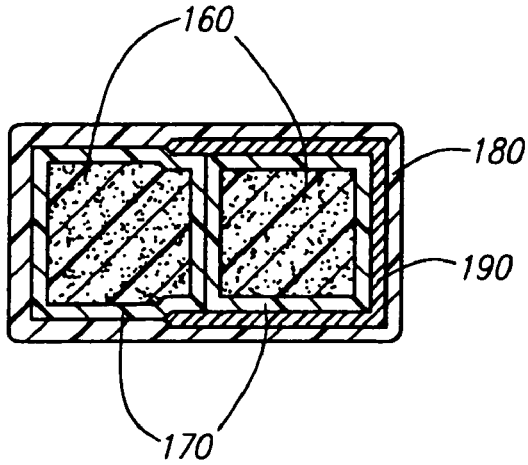
FIG. 8A is a detailed diagram illustrating a cross-sectional view of the hockey stick blade in accordance with the embodiment set forth in FIG. 1 taken along line A-A of FIG. 7.
Figure 8B:
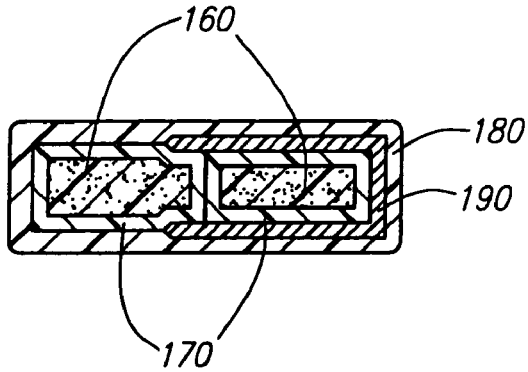
FIG. 8B is a detailed diagram illustrating a cross-sectional view of the hockey stick blade in accordance with the embodiment set forth in FIG. 1 taken along line B-B of FIG. 7.
Figure 8C:
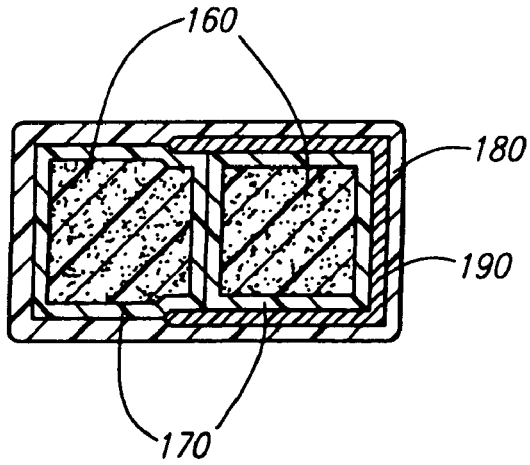
FIG. 8C is a detailed diagram illustrating a cross-sectional view of the hockey stick blade in accordance with the embodiment set forth in FIG. 1 taken along line C-C of FIG. 7.
Figure 9A:
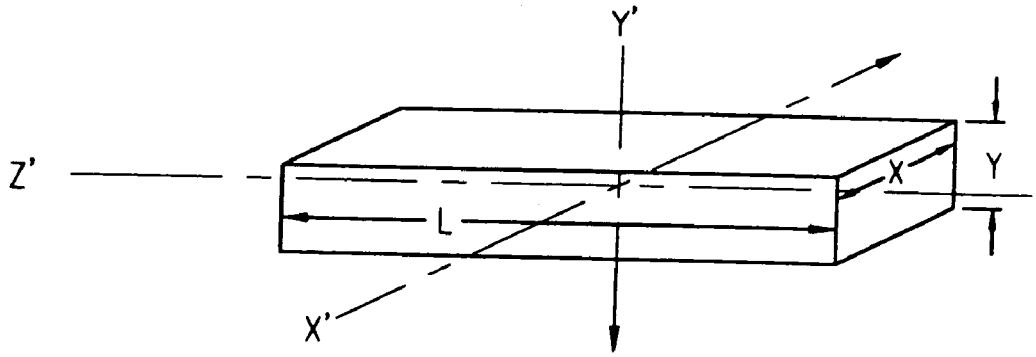
FIG. 9A is a diagram illustrating a member having a longitudinal axis and comprising a rectangular cross-sectional area having width X, height Y and length L.
Figure 9B:
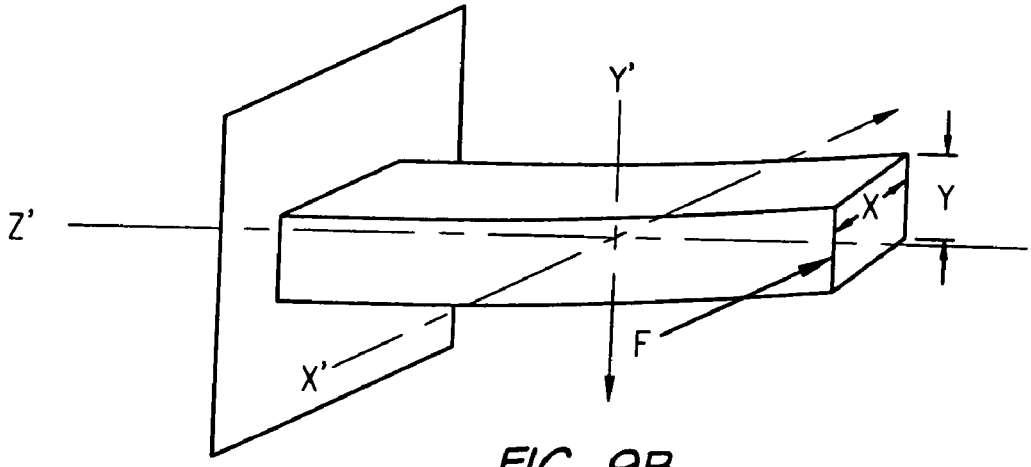
FIG. 9B is a diagram illustrating the member of FIG. 9A with a force applied to the member in the X' direction.
Figure 9C:
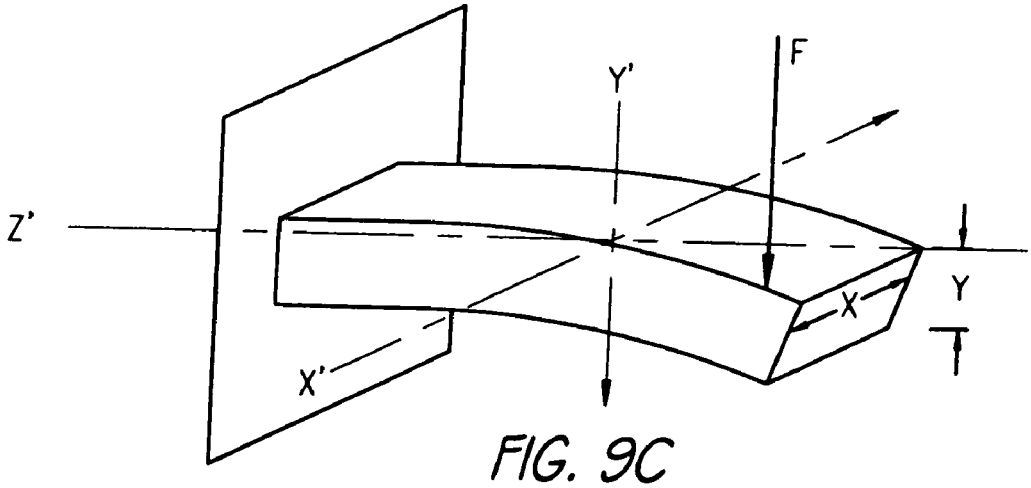
FIG. 9C is a diagram illustrating the member of FIG. 9A with a force applied to the member in the Y' direction.

The blade 30 may be constructed of a variety of materials including wood, plastic, and composite materials such as fiberglass, carbon fiber, Kevlar™, graphite fiber, foam and other materials known to those of ordinary skill in the art. As illustrated in FIGS. 8A-8C, when the blade 30 is formed of composite materials, the blade 30 may be manufactured by using a plurality of inner core pieces 160 composed preferably of compressed foam, such as polyurethane, however, other materials may also be employed such as wood, other foams and fiberglass. The inner core pieces 160 generally are dimensioned generally to have the external shape of the blade 30 when aligned with one another so as to be capable of fitting in a desired mold. Each inner core piece 160 is individually inserted into a first sleeve 170 preferably composed of a woven synthetic reinforcement material such as carbon fiber, fiberglass, Kevlar™ or graphite fiber materials. The inner core pieces 160, having been individually inserted into the woven fiber sleeves 170, are preferably also together enclosed into an additional woven fiber sleeve 180 preferably constructed of the same material as the first sleeve 170. An additional layer of woven fiber reinforcement material 190 may also be layered between the two sets of sleeves on the top section of the blade 30 to form part of walls 31 and 31*a* of the upper portion 90 and the top edge 150 of the blade 30. The section may be sized to form a portion of the front 120 and rear faces 140 of the blade 30. The blade assembly is then inserted into a mold having the desired shape of the blade 30. A suitable matrix material or resin is then injected into mold to impregnate the woven fiber materials 170, 180, 190 and the blade 30 is cured. In the illustrated preferred embodiment, the molding process together with the dimensions of the inner core pieces 160 define the unique shape of the focused flex region 110 on the upper portion 90 of the blade 30.

While there has been illustrated and described what are presently considered to be preferred embodiments and features of the present invention, it will be understood by those skilled in the art that various changes and modifications may be made, and equivalents may be substituted for elements thereof, without departing from the scope of the invention.

In addition, many modifications may be made to adapt a particular element, feature or implementation to the teachings of the present invention without departing from the central scope of the invention. Therefore, it is intended that this invention not be limited to the particular embodiments disclosed herein, but that the invention include all embodiments falling within the scope of the appended claims.

What is claimed is:

1. A hockey stick blade comprising:

a lower portion, extending from a toe section to a heel section to form a front face and a back face of the blade; and an upper portion having a longitudinal axis and comprising a defined region of reduced longitudinal bending stiffness in a direction generally perpendicular to the front face and the back face of the blade when measured relative to regions in the upper portion that border either side of the defined region along the longitudinal axis, wherein the upper portion is configured to be permanently mounted to a hockey stick shaft.

2. The hockey stick blade of claim 1, wherein the defined region of reduced longitudinal bending stiffness comprises a first outer most exterior concave surface having a continuous curved transition into the first outer most exterior surface and a second outer most exterior concave region having a continuous curved transition into the second outer most exterior surface.

3. The hockey stick blade of claim 1, wherein the blade is comprised of one or more inner core elements overlain with one or more layers of fibers disposed in a hardened matrix material.

4. The hockey stick blade of claim 3, wherein at least one of the layers of fibers extend internally within the blade between the front face and the back face.

5. The hockey stick blade of claim 1, wherein the blade is comprised of one or more inner core elements overlain with one or more layers of aligned fibers disposed in a hardened matrix material.

6. A hockey blade configured to be permanently mounted to a hockey shaft comprising:

(a) a lower portion extending from a toe section to a heel section to form a front and a back face of the blade; and (b) an upper portion having a longitudinal axis extending from the heel section toward a mating section adapted to be permanently mounted to a shaft; the upper portion comprising: a front side having a first outer most exterior surface generally facing in the same direction as the front face of the blade; a back side having a second outer most exterior surface generally facing in the same direction as the back face of the blade; and an outer most exterior concave surface having a continuous curved transition into at least one of the first or second outer most exterior surfaces, wherein the concave surface forms a region of reduced width dimension, as measured between the first and second outer most exterior surfaces, relative to bordering regions on either side of the concave surface along the longitudinal axis.

7. The hockey stick of claim 6 further comprising a first outer most exterior concave surface having a continuous curved transition into the first outer most exterior surface and a second outer most exterior concave surface having a continuous curved transition into the second outer most exterior surface.

8. The hockey stick of claim 6, wherein the blade is comprised of one or more inner core elements overlain with one or more layers of fibers disposed in a hardened matrix material.

9. The hockey stick blade of claim 8, wherein at least one of the layers of fibers extend internally within the blade between the front face and the back face.

10. The hockey stick of claim 6, wherein the blade is comprised of one or more inner core elements overlain with one or more layers of aligned fibers disposed in a hardened matrix material.

11. A two piece hockey stick comprising:

(a) a shaft, and (b) a blade configured to be detachably mated to the shaft, said blade comprising:

(i) a lower portion extending from a toe section to a heel section to form a front and a back face of the blade; and (ii) an upper portion, having a longitudinal axis generally extending from the heel toward the shaft, comprising: a front side having a first outer most exterior surface generally facing in the same direction as the front face of the blade; a back side having a second outer most exterior surface generally facing in the same direction as the back face of the blade; and a focused flex region having a continuous curved transition into at least one of the first or second outer most exterior surfaces, wherein the focused flex region has a reduced width dimension, as measured between the first and second outer most exterior surfaces, relative to bordering regions on either side of the focused flex region along the longitudinal axis.

12. The hockey stick of claim 11 further comprising a first outer most exterior concave surface having a continuous curved transition into the first outer most exterior surface and a second outer most exterior concave surface having a continuous curved transition into the second outer most exterior surface.

13. The hockey stick of claim 11, wherein the blade is comprised of one or more inner core elements overlain with one or more layers of fibers disposed in a hardened matrix material.

14. The hockey stick blade of claim 13, wherein at least one of the layers of fibers extend internally within the blade between the front face and the back face.

15. The hockey stick of claim 11, wherein the blade is comprised of one or more inner core elements overlain with one or more layers of aligned fibers disposed in a hardened matrix material.

16. A hockey stick comprising:

a shaft and a blade adapted to being joined to the shaft comprising,:

a lower portion extending from a toe section to a heel section to form a front and a back face of the blade; and an upper portion having a longitudinal axis generally extending from the heel toward the shaft, the upper portion being comprised of a defined region of reduced longitudinal bending stiffness in a direction generally perpendicular to the faces of the blade when measured relative to regions in the upper portion of the blade that border either side of the defined region along the longitudinal axis.

17. The hockey stick blade of claim 16, wherein the defined region of reduced longitudinal bending stiffness comprises a first outer most exterior concave surface having a continuous curved transition into the first outer most exterior surface and a second outer most exterior concave region having a continuous curved transition into the second outer most exterior surface.

18. The hockey stick blade of claim 16, wherein the blade is comprised of one or more inner core elements overlain with one or more layers of fibers disposed in a hardened matrix material.

19. The hockey stick blade of claim 18, wherein at least one of the layers of fibers extend internally within the blade between the front face and the back face.

20. The hockey stick blade of claim 16, wherein the blade is comprised of one or more inner core elements overlain with one or more layers of aligned fibers disposed in a hardened matrix material.

* * * * *